US005931640A

United States Patent [19]

Van Houten et al.

[11] Patent Number: 5,931,640

[45] Date of Patent: Aug. 3, 1999

[54] OPPOSITELY SKEWED COUNTER-ROTATING FANS

[75] Inventors: Robert J. Van Houten, Winchester, Mass.; Robert I. Hickey, Concord, N.H.

[73] Assignee: Robert Bosch Corporation, Waltham, Mass.

[21] Appl. No.: 08/954,289

[22] Filed: Oct. 17, 1997

Related U.S. Application Data

[60] Provisional application No. 60/029,360, Oct. 31, 1996.

[51] Int. Cl.[6] ..... B63H 5/10; F01D 1/24

[52] U.S. Cl. ..... 416/128; 416/238; 416/169 A

[58] Field of Search ..... 416/128, 169 A, 416/189, 192, 200 R, 238

[56] References Cited

U.S. PATENT DOCUMENTS

| | | | |
|---|---|---|---|
| 162,619 | 4/1875 | Browne | 416/128 |
| 3,127,093 | 3/1964 | Sudrow | 416/128 X |
| 4,306,839 | 12/1981 | Pien | 416/200 R |
| 4,548,548 | 10/1985 | Gray, III | 416/189 |
| 4,840,221 | 6/1989 | Dumas et al. . | |
| 4,907,645 | 3/1990 | Dumas et al. . | |
| 4,969,800 | 11/1990 | Parry et al. | 416/238 |
| 5,320,493 | 6/1994 | Shih et al. | 416/238 X |

FOREIGN PATENT DOCUMENTS

| | | | |
|---|---|---|---|
| 1213966 | 11/1986 | Canada . | |
| 2257909 | 11/1972 | Germany . | |
| 3316110 | 11/1984 | Germany . | |
| 175922 | 3/1922 | United Kingdom | 416/128 |
| 177047 | 3/1922 | United Kingdom | 416/128 |
| 2082688 | 3/1982 | United Kingdom . | |

*Primary Examiner*—John E. Ryznic
*Attorney, Agent, or Firm*—Fish & Richardson P.C.

[57] ABSTRACT

A counter-rotating fan which comprises a forward-skewed upstream rotor and a backskewed downstream rotor. The counter-rotating fan may be used in a cooling module with a heat exchanger, for example as an engine cooling fan in a vehicle.

5 Claims, 4 Drawing Sheets

OPPOSITELY SKEWED COUNTER-ROTATING FANS

CROSS-REFERENCE TO RELATED APPLICATIONS

This application claims the benefit of the filing date of U.S. provisional application 60/029,360, filed Oct. 31, 1996, which is hereby incorporated by reference.

FIELD OF THE INVENTION

This invention is in the general field of counter-rotating fans.

BACKGROUND AND SUMMARY OF THE INVENTION

Counter-rotating fans include two rotors, rotating in opposite directions about axes which are at least approximately coaxial. Air passes first through the upstream rotor, and then through the downstream rotor. Such fans can have advantages in efficiency and noise.

Because the rotors operate in opposite directions, the swirl velocities induced by the upstream rotor tend to be cancelled in some measure by the swirl velocities induced by the downstream rotor, so that the air leaving the counter-rotating fan tends to have relatively little swirl velocity. Since less energy is imparted to the air relative to a conventional fan consisting of a single rotor, the counter-rotating fan has the potential to provide higher efficiency than conventional fans.

Efficiency can also be enhanced due to a reduction in parasitic losses compared to a conventional fan. To illustrate with an idealized case, when two rotors are used to move the air, the pressure rise generated by each rotor is roughly half that required of a conventional fan. Each fan can therefore be operated at approximately half the speed of a conventional fan. If parasitic losses are assumed to be approximately proportional to the square of the rotation speed, then losses associated with each rotor would be about one quarter of the losses on a conventional fan, and the total losses are about one-half those of a conventional fan.

Due to the relatively low rotational speed of the rotors of a counter-rotating fan, the broadband noise tends to be quite low. However, when the downstream rotor blades encounter the wakes of the upstream rotor blades, these fans can generate acoustic tones.

In an effort to reduce these tones, skewed blades can be used. The wake of a skewed downstream blade will in general encounter the wake of a similarly skewed upstream blade in a very gradual manner, thereby minimizing tones. For instance, a backskewed upstream rotor can be combined with a similarly backskewed downstream rotor, and a forward-skewed upstream rotor will often be combined with a similarly forward-skewed downstream rotor. Skewed blades also are beneficial in that they reduce the broadband noise generated by the fan.

Although both forward-skewed and backskewed fans have favorable acoustic properties, they exhibit other aerodynamic characteristics which are quite different. In general, conventional backskewed fans can exhibit favorable performance at the low-static-pressure, high-flow condition compared to a forward skewed fan. However, backskewed fans sometimes tend to stall when they are mounted downstream of a heat-exchanger, as is often the case when they are used as an engine-cooling fan in an automotive vehicle. Forward-skew fans generally do not exhibit this characteristic.

A counter-rotating fan which has a forward-skewed upstream rotor and a backskewed downstream rotor can be particularly beneficial. The choice of a forward-skewed upstream rotor is beneficial because it does not exhibit on-system stall when mounted behind a heat exchanger. The choice of a backskewed rotor for the downstream rotor is beneficial because it improves the performance of the fan at low static pressures.

Such fans have surprisingly good acoustic properties. Because the blade skew of a forward-skew fan lines up geometrically with the skew of a backskew fan turning in the opposite direction, one would normally assume that the downstream rotor blades would encounter the wakes of the upstream blades in a sudden, non-gradual manner, producing acoustic tones. However, such is not the case. The acoustic characteristics can be superior to those of a conventionally skewed counter-rotating fan.

Without wishing to bind ourselves to any single explanation, swirl velocities between the fans may vary considerably with radial position, so the shape of the upstream rotor wakes differs considerably from the shape of the upstream blade geometry; thus the downstream blades encounter these wakes in a more gradual manner than would be suggested by the geometry.

DESCRIPTION OF THE PREFERRED EMBODIMENTS

Figure 1:
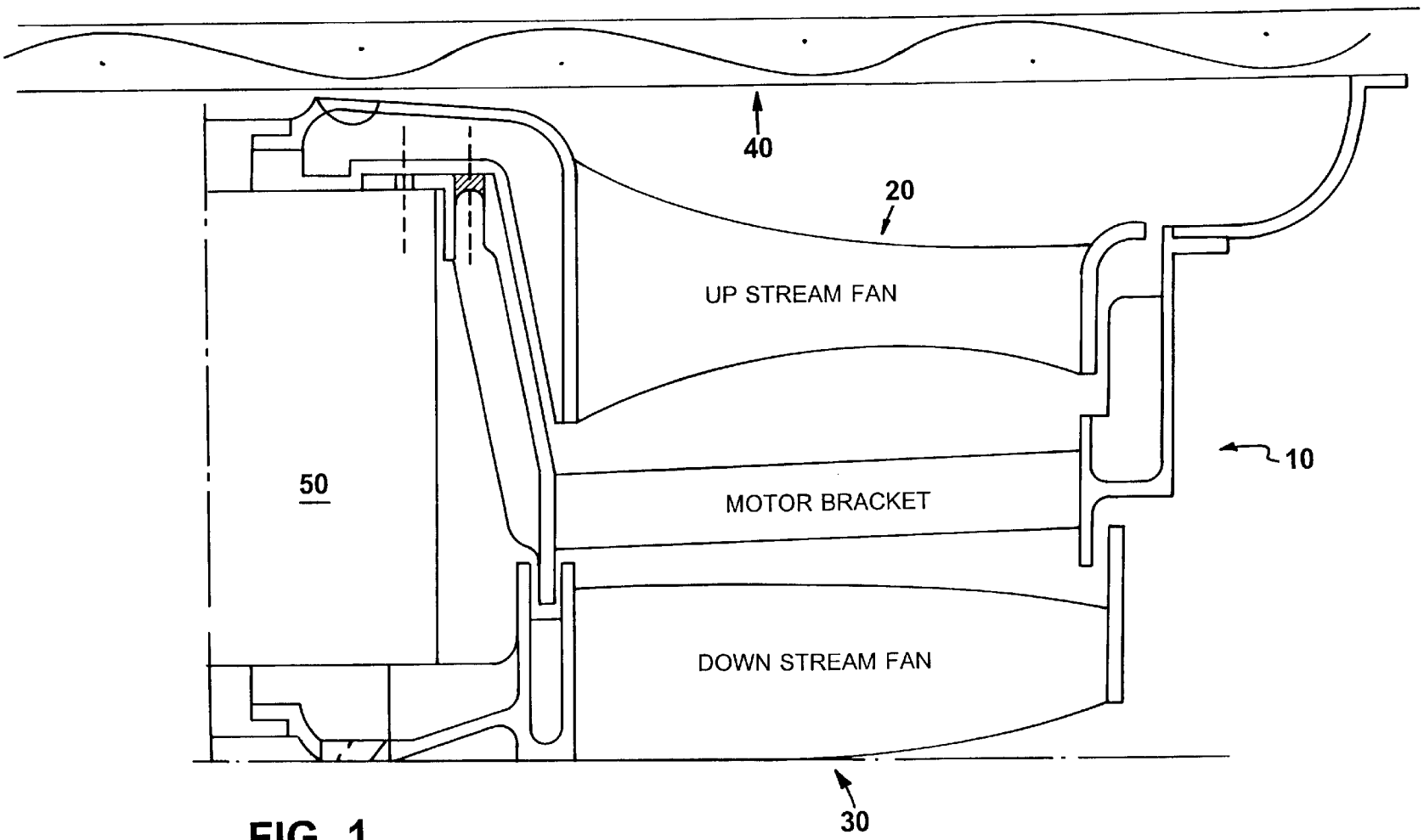
FIG. 1 is a diagrammatic representation of a counter-rotating fan and motor.

FIG. 1 shows a counter-rotating fan 10 having a upstream rotor 20 which is forward skewed and a downstream rotor 30 which is rearwardly skewed. Both fans are driven by a counter-rotating motor 50.

Figure 4:
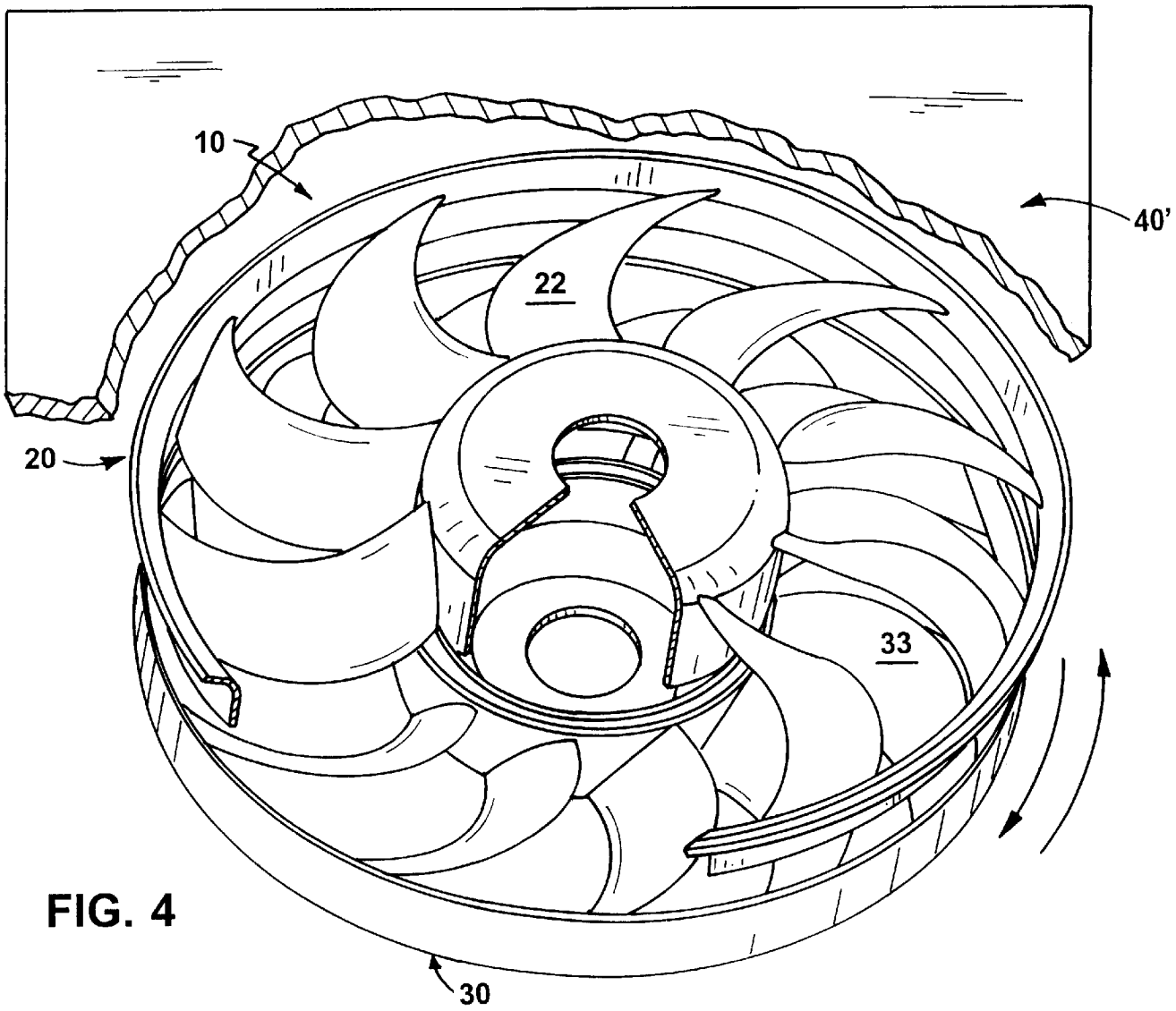
FIG. 4 is a perspective of a counter-rotating fan (without the motor).

As noted above, the counter-rotating fan may be advantageously mounted downstream of (behind) a heat exchanger 40 to pull air through it. In that case, the forward-skewed upstream rotor will not exhibit on-system stall which sometimes characterizes rearwardly skewed fans positioned downstream of a heat exchanger. Heat exchanger 40, fan 10 and motor 50 are part of an engine cooling module for use in a vehicle. Also, FIG. 4 shows heat exchanger 40' downstream of the counter-rotating fans.

Figure 2:
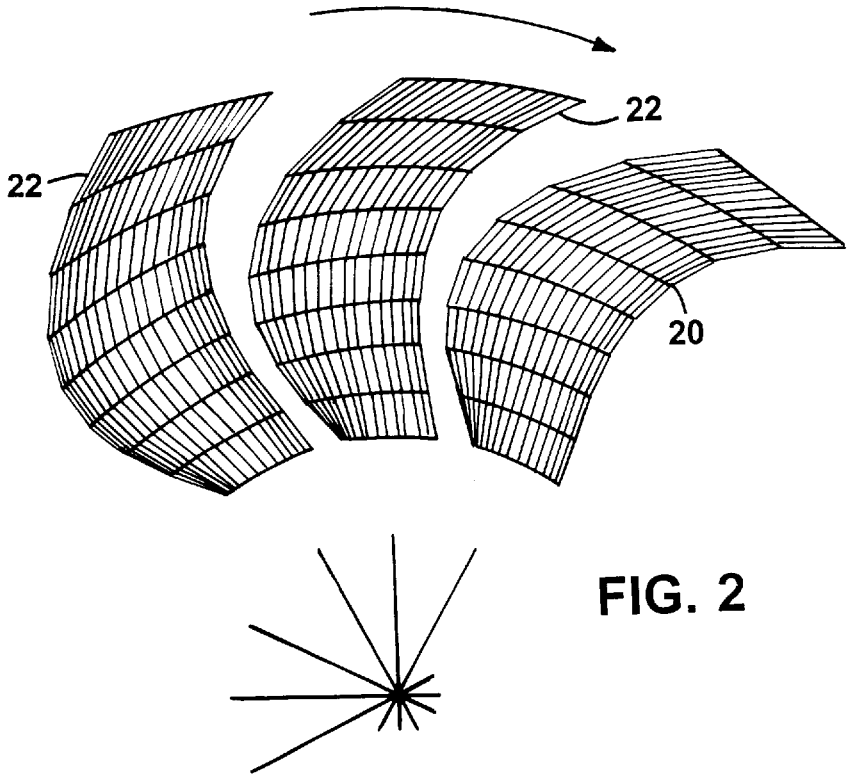
FIG. 2 is a highly schematic view of the upstream blades of the fan of FIG. 1.
Figure 5:
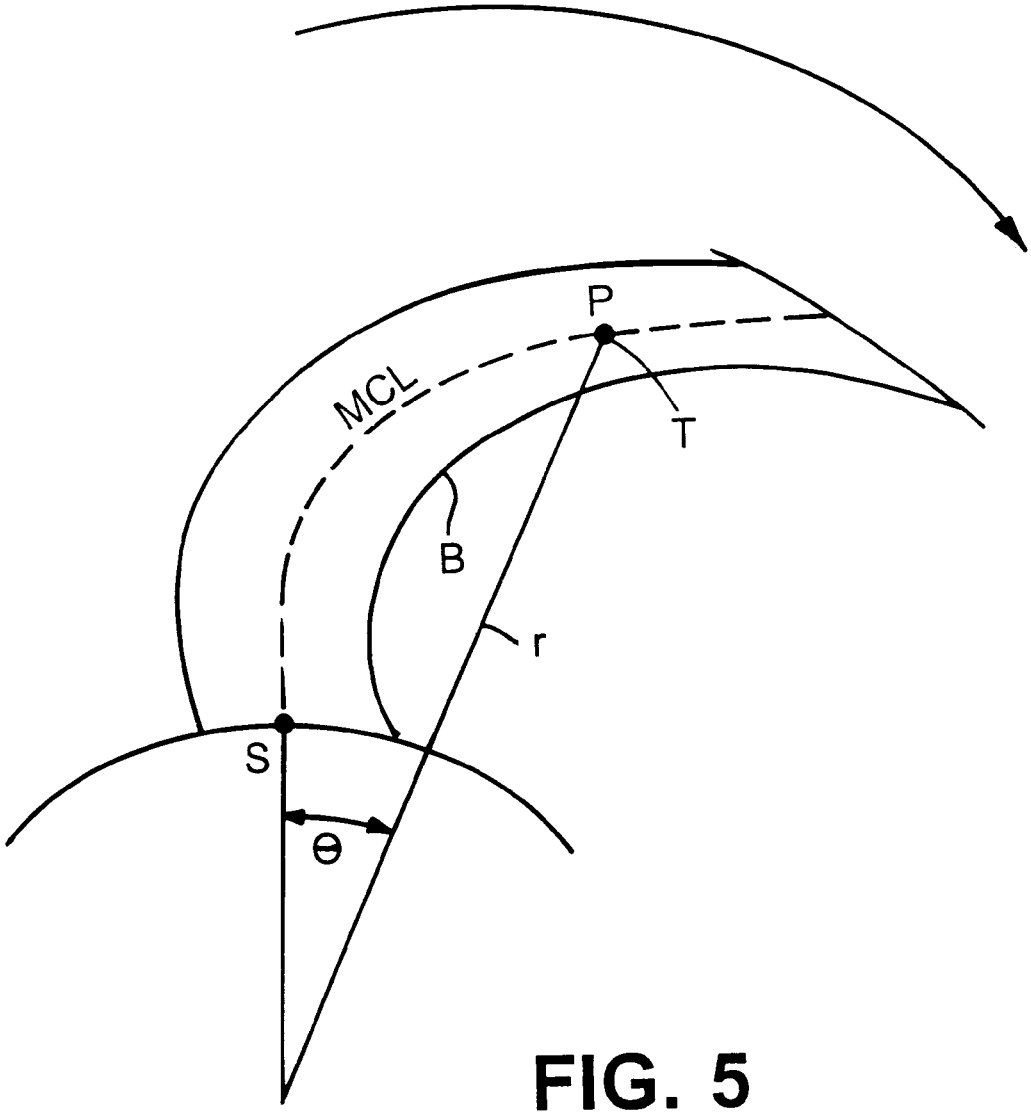
FIG. 5 is a diagram illustrating the mid-chord line and the skew angle.

FIG. 2 is a diagram looking from the upstream direction showing the shape of the forwardly skewed blades 22 of fan 20. At least for $r/R>0.85$ (and preferably for $r/R>0.7$), the upstream fan blade is forwardly skewed in the sense that the skew angle $\theta$ (defined below) increases or becomes less negative in this region. Regarding skew angle $\theta$, FIG. 5 is a diagram showing the projection on the plane of rotation of a hypothetical fan blade B. Blade B has an overall mid-chord line from the root to the tip of the blade shown as broken line MCL. Blade B has a mid-chord point S at the root and a mid-chord point T at any given radius r. The skew angle $\theta$ at radius r is the angle between a radial line through S and a radial line through T, the mid-chord point at radius r. See also U.S. Pat. No. 4,358,245, hereby incorporated by reference.

Figure 3:
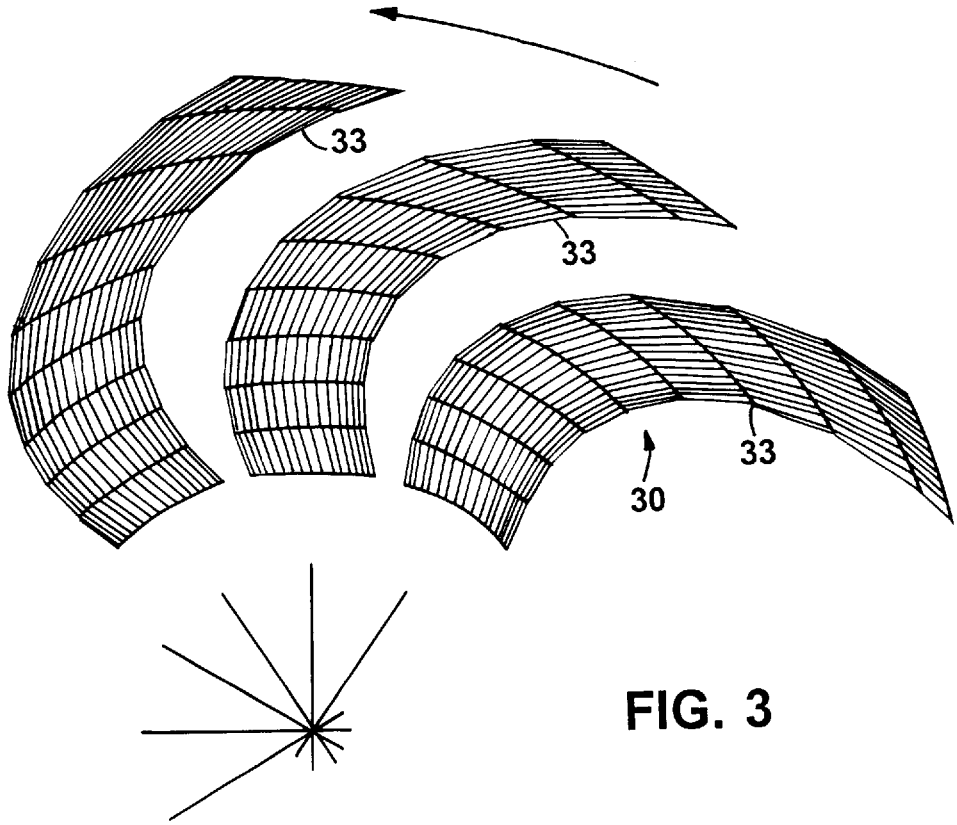
FIG. 3 is a highly schematic view of the downstream blades of the fan of FIG. 1.

Similarly, FIG. 3 is a diagram of the downstream rotor blades looking from the upstream direction. At least for r/R>0.85 (and preferably for r/R>0.7), the downstream blades are rearwardly skewed meaning that they have a rearwardly curved skew line in the sense that the skew angle θ decreases or becomes increasingly negative in this region.

While not limiting ourselves to specific blade geometry, we note one particular such counter-rotating fan module.

| Non-dim. rad. (r/R) | Upstream Skew | Downstream Skew |
|---|---|---|
| 0.420 | −0 | −0 |
| 0.493 | −4.4° | 2.35° |
| 0.565 | −6.7° | 2.85° |
| 0.637 | −7.3° | 1.62° |
| 0.710 | −6.6° | −1.25° |
| 0.783 | −4.3° | −5.66° |
| 0.855 | −0.7° | −11.48° |
| 0.928 | 4.3° | −18.63° |
| 1.000 | 10.0° | −27.00° |

What is claimed is:

1. An assembly comprising a counter-rotating fan which comprises a forward-skewed upstream rotor and a back-skewed downstream rotor.

2. An assembly comprising the fan of claim 1 further comprising an adjacent heat exchanger through which the fan moves air.

3. The assembly of claim 2 in which the heat exchanger is positioned upstream of the fan.

4. The assembly of claim 2 in which the heat exchanger is positioned downstream of the fan.

5. The assembly of claim 1 sized and shaped for use as an engine cooling module in a vehicle.

* * * * *